United States Patent [19]

Marion

[11] 4,153,190

[45] May 8, 1979

[54] MAGNETIC FEEDING DEVICE

[75] Inventor: Thomas E. Marion, Baltimore, Md.

[73] Assignee: Universal Machine Co., Inc., Baltimore, Md.

[21] Appl. No.: 856,017

[22] Filed: Nov. 30, 1977

Related U.S. Application Data

[63] Continuation-in-part of Ser. No. 770,280, Feb. 18, 1977, which is a continuation of Ser. No. 624,070, Oct. 20, 1975, abandoned.

[51] Int. Cl.[2] ..... B65H 23/18; B65H 17/22; B65H 17/36

[52] U.S. Cl. ..... 226/33; 226/39; 226/145; 226/153; 226/162

[58] Field of Search ..... 226/32, 33, 34, 39, 226/145, 153, 162

[56] References Cited

U.S. PATENT DOCUMENTS

| | | | |
|---|---|---|---|
| 1,951,844 | 3/1934 | Rose | 226/33 X |
| 3,025,740 | 3/1962 | Sorkin | 226/145 UX |
| 3,276,648 | 10/1966 | Lewis | 226/33 |

*Primary Examiner*—Richard A. Schacher
*Attorney, Agent, or Firm*—Birch, Stewart, Kolasch and Birch

[57] ABSTRACT

Means are provided for accurate incremental feeding of web material from a supply to a work station by a combination of intermittent drive means for advancing the web and electrically controlled magnetic brake means for clamping and stopping the web after a desired increment thereof has been fed from the supply to the work station. In one embodiment the intermittent drive means comprises a second magnetic brake means reciprocated through advance and retraction strokes of predetermined length which is actuated and deactuated in phase opposition with the first brake means to effect the incremental advance of the web. In another the embodiment intermittent drive means is comprised of sequential feed rolls which nip the web material over a predetermined circumferential extent of the rolls to effect a given incremental advance. If the web carries registration marks defining the exact increment of advance desired then a photodetector is used to trigger one or both brake means when the proper increment of advance has been achieved. In this event the intermittent drive means is set to advance the web in slightly larger increments than those desired and the photodetector thus controls the final incremental length of the web presented to the work station. Both of these embodiments are adapted to heavier materials or those requiring greater gripping force by dual magnets having opposed core and coil assemblies of opposite polarities.

26 Claims, 5 Drawing Figures

Fig. 4
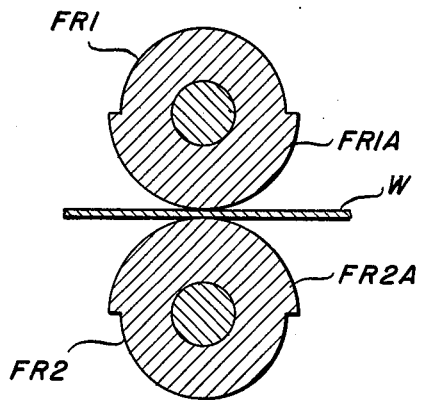
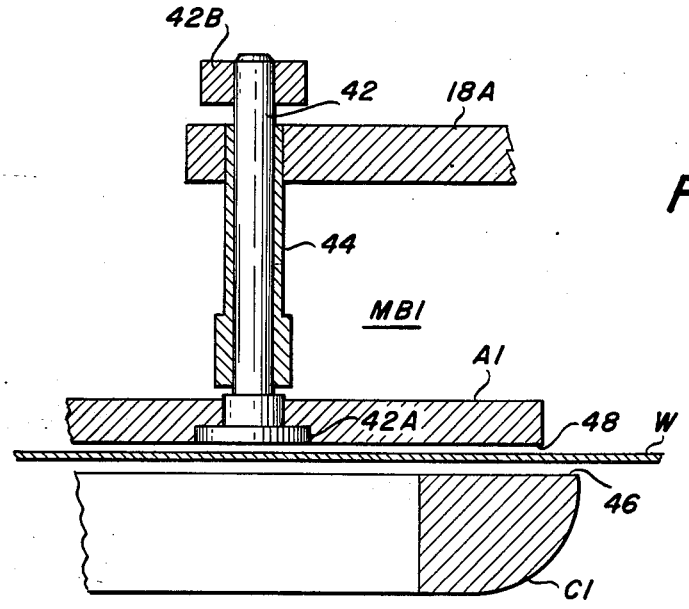
Fig. 5

MAGNETIC FEEDING DEVICE

This application is a Continuation-In-Part of copending application Ser. No. 770,280, filed Feb. 18, 1977, of Thomas E. Marion for MAGNETIC FEEDING DEVICE which in turn, is a Continuation of application Ser. No. 624,070 filed Oct. 20, 1975, the latter now being abandoned.

FIELD OF THE INVENTION

This invention relates to web feeding and more particularly to the feeding of elongated webs of thin material such as paper, paperboard, plastic film and the like in accurate increments of predetermined length for successive presentation to cutting, punching or other work stations.

BACKGROUND OF THE INVENTION

Conventional apparatus for feeding rolls of web material to a work station in accurate increments is relatively complex and expensive. In the advancement of web material containing repetitive printed patterns which are properly cut, punched out or otherwise operated on to produce blanks or objects in which the said patterns are properly indexed. A typical web feeding device requires a set of feed rolls moving continuously at web speed; a set of intermittently feeding rolls to deliver the required incremental feed length; an electric eye unit to sense indexing marks on the web; a selector switch to position the desired web length; a transmission unit to enable the advance and/or retard positions of the feed rolls; a forward and reverse motor to control the transmission unit; and a driving means for driving the two sets of feed rolls and the transmission unit.

Despite the complexity and sophistication of the foregoing type of apparatus, slippage and loss of registry still occur, resulting in an undesirable amount of scrap waste due to loss of registry of patterns and the like.

OBJECTS OF THE INVENTION

It is, therefore, an object of the present invention to provide new and novel feed means for feeding accurate predetermined incremental lengths of web material from a supply of the latter to a work station.

Still another object of the present invention is to provide new and novel feed means for feeding accurate predetermined incremental lengths of web material from a supply of the later to a work station; and which is capable of feeding webs containing indexed repetitive patterns with optimally minimum loss of registry of said patterns.

Still another object of the present invention is to provide new and novel feed means for feeding accurate predetermined incremental lengths of web material from a supply of the latter to a work station which is less complex and more accurate than previously known web feed means of the type described.

Yet another object of the present invention is to provide new and novel feed means for feeding accurate predetermined incremental lengths of web material from a supply of the latter to a work station in which electromagnetic and photoelectric means are utilized to effect the accurate indexing of the web material being fed.

These and other objects of the present invention will become more fully apparent with reference to the following specification and drawings which relate to preferred embodiments of the invention.

SUMMARY OF THE INVENTION

In a first preferred embodiment of the present invention web material bearing pattern or other registration marks is fed from a roll to a work station by means of a reciprocating carriage, a drive motor for the carriage, and an electromagnetic clamp means mounted on the carriage for reciprocation with the latter. The clamp means is energized to engage the web and move it with the carriage along its advance path of travel through a given increment of travel which, if uncontrolled, is in excess of the desired incremental advance for the web material.

An adjustably positioned photodetector senses the presence of the registration mark and triggers a flip-flop or other logic control device to disengage the magnetic clamp when the proper increment of web material has been advanced. The logic control device also simultaneously energizes a second magnetic clamping means mounted upstream from the work station at a fixed position such that the web is abruptly engaged and stopped when registry is detected by the photodetector.

When the carriage recycles through its backstroke, a limit switch is engaged to reverse the state of the logic control device thereby re-energizing the first clamp and de-energizing the second clamp to cause a successive incremental advance of the web material on the next advance stroke of the carriage.

In a second preferred embodiment of the invention, the carriage and first magnetic clamp are replaced by segmented feed rolls which have a circumferential engagement with the web material that results in a maximum advance slightly in excess of the desired incremental advance.

In this embodiment, when the photodetector senses the registration mark and triggers the control logic, the remaining second or fixed magnetic clamp means is abruptly energized to grip the web and stop its advance feed, thereby causing the segmented feed rolls to slip in the web material for the remainder of their designed feed increment.

A position sensing switch in the segmented feed roller drive train is provided to reverse the state of the control logic just prior to the initiation of each successive incremental advance of the web material.

Where enhanced gripping strength of the magnetic clamps is required or desired to increment heavier web materials or those which require more gripping strength for accurate incrementation, the magnetic clamps are constructed of a fixed magnetic coil and core energized at a first polarity and a floating opposed magnetic core and coil, acting as an armature, energized at a reverse polarity to that of the fixed coil and core. This doubles the available magnetic force in the magnetic clamp and thereby increases the available gripping force therein.

In each embodiment, the position of the detector head of the photodetector is adjustable relative to the work station to provide adaptability of the present invention to different size feed increments of the web material.

BRIEF DESCRIPTION OF THE DRAWINGS

FIG. 4 is an enlarged cross-section of the segmented feed rolls of FIG. 3 taken transversely of the axes of rotation thereof;

FIG. 5 is a partial cross-section of one of the magnetic clamps common to both embodiments; and FIG. 6 is a side elevation in partial cross-section of a dual magnet embodiment of the electromagnetic clamp assembly of FIG. 5 and illustrating, schematically, drive amplifier connections for energizing same.

DETAILED DESCRIPTION OF THE DRAWINGS

A. Dual Magnetic Brakes

Figure 1:
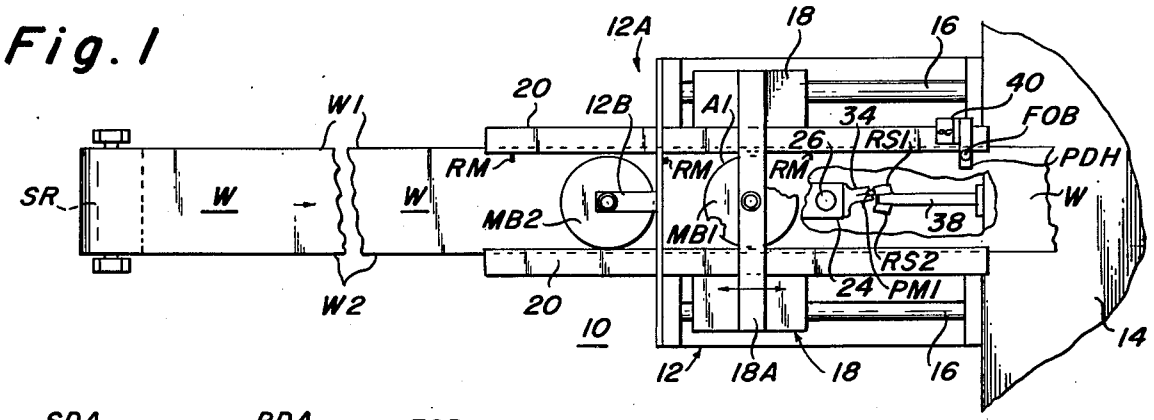
FIG. 1 is a top plan view, partially broken away, of a first embodiment of the present invention.

The first embodiment of the web feed device 10 of the present invention illustrated in FIGS. 1, 2 and 5, which show a machine frame 12 mounted on a machine bed 14, the latter being adapted to hold a work station (not shown) which will be described hereinafter with reference to FIG. 3.

Intermediate the vertical extent of the frame 12, there are incorporated parallel, horizontal guide rails 16 on which is transversely mounted a carriage 18 which is adapted to be reciprocated back and forth along the guide rails 16.

Between and above the guide rails 16 and carriage 18 are mounted web guides 20 which extend parallel to the guide rails 16 and outboard of the web input side 12A of the frame 12. The web guides 20 consist of parallel grooved rails with the web material W having its longitudinal edges W1, W2 riding in the grooves as generally illustrated in FIG. 1 and as conventionally known in the web feeding art.

The carriage 18 includes an inverted U-shaped bracket 18A in the form of a bridge or the like which extends up and over the web guides 20 in the provision of a mounting bracket for a magnetic armature A1 of a first magnetic brake or clamp assembly MB1. The core and coil assembly C1 of the first magnetic brake MB1 is mounted on a suitable plate or support surface 18B of the carriage 18 immediately beneath the lower surface of the web W. The armature A1 is mounted immediately above the upper surface of the web W.

The carriage 18 is driven through its reciprocations by means of a cam roller 22 mounted on one end of a crank arm 24 which in turn is mounted at its other end for rotation with the upper end of a drive shaft 26. The drive shaft 26 carries a first bevel gear 28 at its lower end which is driven by a second bevel gear 30 mounted on a primary power shaft 32 which extends to a power drive means (not shown) in the machine base 14. Suitable journal and other bearing means are conventionally provided for the drive shaft 26 and power shaft 32 as is well known in the art.

The drive roller 22 engages a slotted bearing plate 18C on the lower extremity of the carriage 18 to effect a rotary-to-reciprocating drive function as is also well known in the art. The radial displacement of the drive roller 22 to the axis of the drive shaft 26 can be adjusted on the crank arm 24 to control the length of stroke of the carriage 18 along the guide rails 16.

Each full rotation of the drive shaft 26 effects a full reciprocation cycle of the carriage 18.

In the context of the present invention it is necessary to monitor the occurrence of advanced and retracted positions of the carriage 18. This is accomplished by first and second permanent magnets PM1 and PM2 mounted one above the other on the outer tips of radial cranks 34 and 36, respectively, on the drive shaft 26 which hold the said permanent magnets in the phase relationahip to selectively actuate first and second reed switches RS1 and RS2, respectively, the latter being mounted on a bracket 38 affixed to the machine bed 14.

The web W is provided along its edge W1 with a plurality of evenly spaced registration mark RM which are printed, embossed or otherwise suitably placed on the web material W either before or after it is gathered into a supply roll SR upstream of the fram 12.

In order to sense the occurrrence of these registration marks RM at given desired positions with reference to the frame 12, there is provided a photodetector head PDH comprising a bidirectional fiber-optic bundle FOB positioned by means of an adjustable clamping bracket 40 on the web guide 20 adjacent the web edge W1. Thus, the tip of the fiber-optic bundle FOB is positioned immediately above the path of travel of the registration marks RM such that when the latter pass beneath the former a change in illumination is detected and a suitable signal is then generated as will be more fully described hereinafter.

A second magnetic brake or clamp assembly MB2 is mounted on at the input side of the frame 12 between the web guides 20 and includes an armature assembly A2 and a core and coil assembly C2.

The armature assembly A2 is mounted beneath a contilevered arm 12B on the front end 12A of the frame 12 between the web guides 20 and above the upper surface of the web W. The core and coil assembly C2 is mounted on a bracket 12C between the web guides 20 and below the lower surface of the web W.

The structures of the two magnetic brakes or clamps MB1, MB2 are identical. As shown in FIG. 5, the magnetic brake MB1 comprises a circular armature disc A1 mounted on a press fitted or swaged collar 42A of a spindle 42, the latter being reciprocable to a limited extend in a vertical guide sleeve 44 fixed to the mounting bracket 18A. An enlarged boss 42B on the upper end of the spindle 42 prevents excessive downward motion of the spindle 42 and the armature disc A1.

The core and coil assembly C1 is of a generally toroidal configuration having flat top surface 46 which cooperates with the lower surface 48 of the armature disc A1 to clamp the web W therebetween when the coil and core assembly C1 is energized by a suitable electric current.

When the core and coil assembly C1 is not electrically energized, the clamping force is released except for the gravitational affect on the armature disc A1 and the web W can freely be drawn between the disc A1 and core C1. The disc A1, if desired, can be spring biased upwardly by conventional means to relieve even the gravitational friction imparted to the web W thereby.

The magnetic brakes MB1 and MB2 are controlled in a timed and coordinated manner by a logic circuit having as its inputs, the magnetic reed switches RS1, RS2 and the photodetector PDH as will now be described.

The control module CE for the logic circuit is a flip-flop type of logic module comprising a commercially available integrated circuit such as a CD4011AF having conventional terminal pin connections #1–#14, inclusive, with a 12 volt positive DC input bias at the #14 terminal.

The first reed switch RS1 selectively completes a circuit between a ground lead G1 and a signal lead S1, the latter being directly connected from the switch RS1 to the #1 terminal pin of the control module CE.

The second reed switch RS2 selectively completes a circuit between a ground lead G2 and a signal lead S2, the latter being directly connected from the reed switch RS2 to the #6 terminal of the control module CE.

Figure 2:
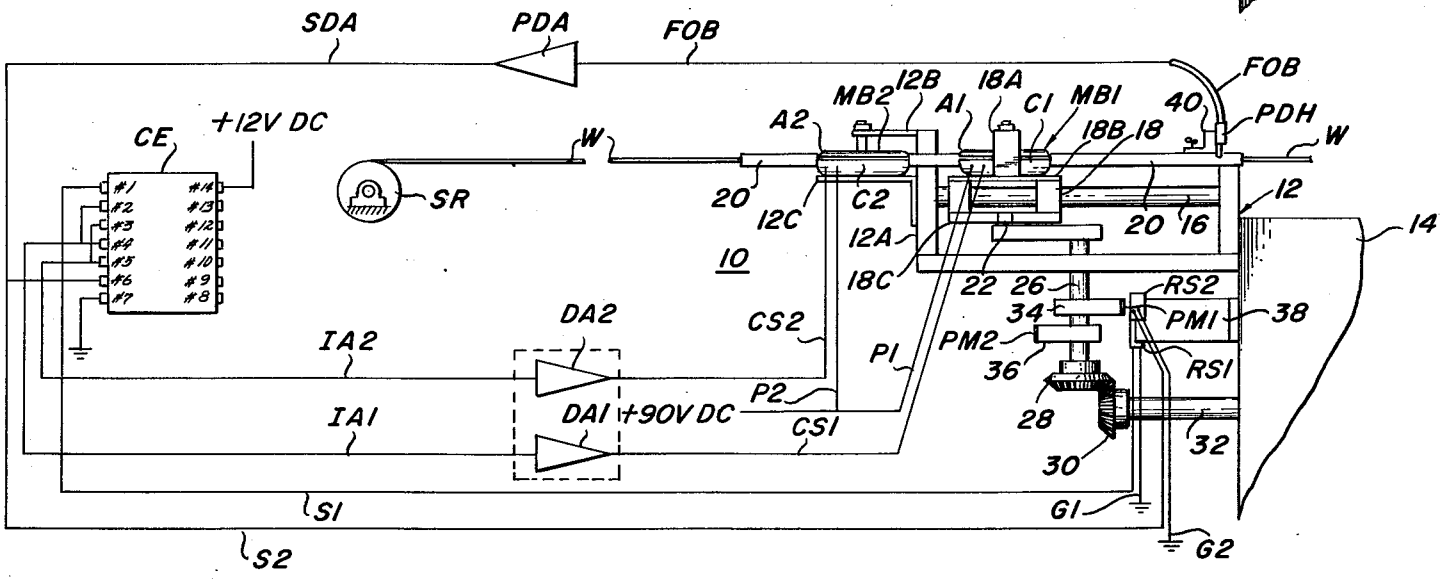
FIG. 2 is a side elevation of FIG. 1 including a schematic of a control circuit for the said first embodiment of the invention.

The coil assemblies C1 and C2 of the first and second magnetic brake means MB1 and MB2 have respective power leads P1 and P2 connected to a power source indicated in FIG. 2 as 90 volts positive D.C.

Signal leads CS1 and CS2 extend from the coil assemblies C1 and C2, respectively, to the outputs of high voltage driven amplifiers DA1 and DA2. The input leads IA1 and IA2 are connected, respectively, to the terminal pin pairs #2, #4 and #3, #5 of the control module CE.

The fiber optic bundle FOB serves as the input to a photodetector amplifier PDA (such as a Banner #B-4-1500B), the latter having its output lead SDA commonly connected to the #6 terminal pin of the control module CE with the signal lead S2 from the reed switch RS2.

The circuit is completed by grounding the #7 terminal pin of the control module CE.

B. Single Magnetic Brake And Segmented Feed Rolls

Another preferred embodiment of the present invention will now be described with reference to FIGS. 3 and 4 wherein like numerals refer to like elements of the embodiment of FIGS. 1, 2 and 5.

In this embodiment, the fixed magnetic brake element MB2 adjacent the input end of the frame 12 has its armature A2 mounted on a bridge 102 mounted on the machine frame 12 and its coil and core assembly C2 mounted on a bracket or plate 104 above and below the web W, respectively, in the manner previously described.

Instead of a carriage and travelling magnetic brake, upper and lower segmented feed rolls FR1 and FR2, respectively, are journalled in the frame 12 by journal means 106 transversely of the web W and between the web guides 20 by means of roll shafts 108 and 110.

These segmented feed rolls FR1, FR2 have circumferential arcuate feed surface segments FR1A, FR2A which are timed to mutually engage the web W by means of end-mounted meshed timing gears TG1 and TG2, respectively, mounted on the roll shafts 108 and 110.

The lowermost feed roll FR2 is the primary driven roll and carries a drive sprocket DS keyed on the roll shaft 110 at the opposite end thereof from the timing gear TG2.

The drive sprocket DS is drivent by a toothed timing belt or chain 112 which in turn is reeved about and driven by a power sprocket PS, the latter being keyed for rotation with a drive shaft 114 which extends into the machine bed 14 to a conventional main power drive (not shown).

The drive shaft 114 mounts the crank 34 and permanent magnet assembly PM1 which triggers the reed switch RS1 associated therewith. The reed switch RS1 is mounted adjacent the drive shaft 114 by any suitable bracket means 116 which is schematically illustrated.

The feed segments FR1A, FR2A of the segmented feed rolls FR1, FR2 are circumferentially dimensioned slightly in excess of the desired length of the web W to be indexed to the work station WS, the latter being schematically shown as a guillotine web cutter on the machine bed 14 adjacent the inboard end of the web guides 20 and frame 12. The work station WS can be a cutter, puncher, pattern printer or the like, as desired.

The pressure exerted on the web W by the nip of the segmented feed rolls FR1, FR2 is sufficient to advance a relatively unimpeded web W but to effect a slipping on the web in the event the magnetic brake MB2 is actuated to grip or clamp the web W between the armature disc A2 and the upper surface of the coil and core assembly C2.

Figure 3:
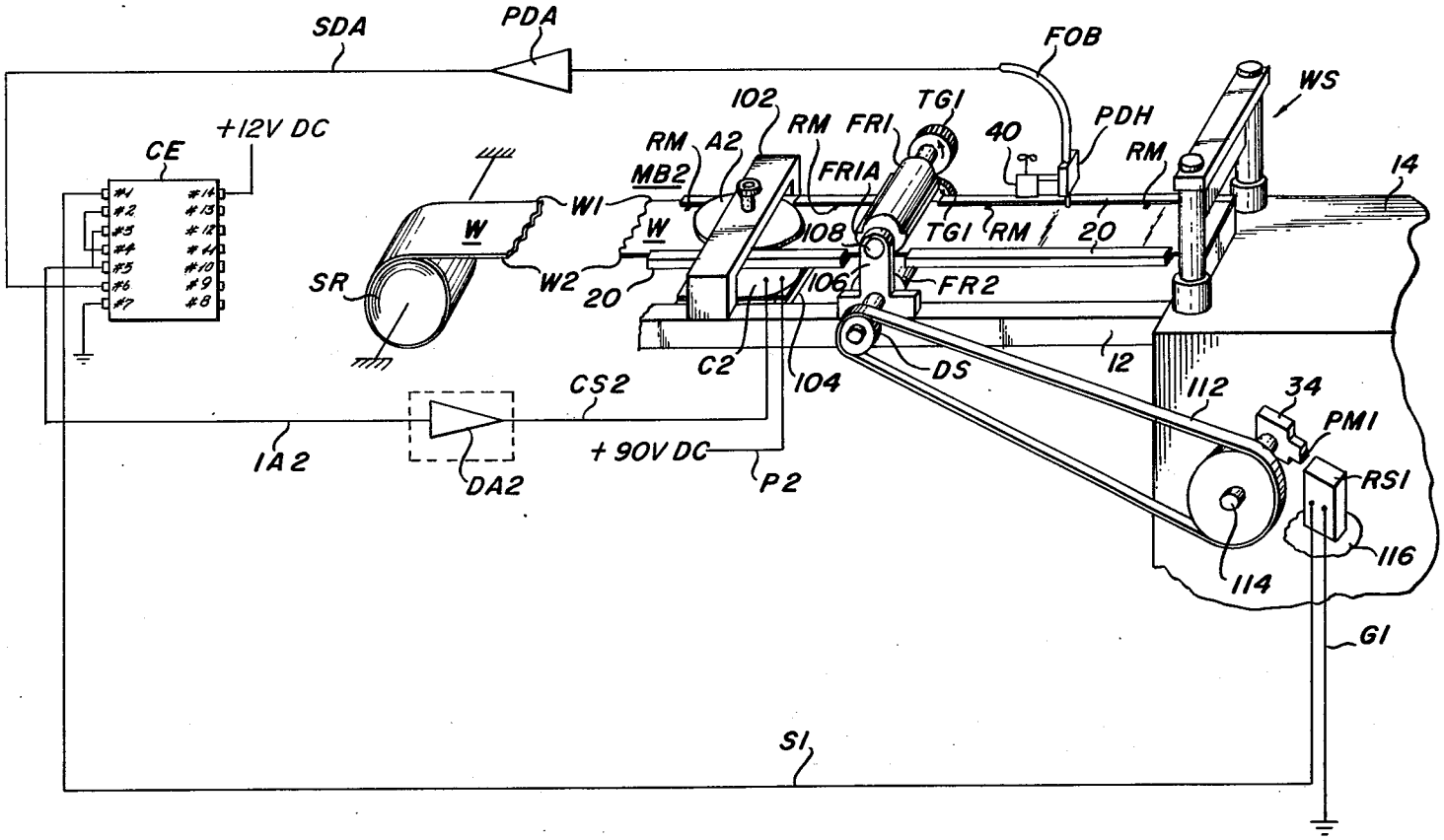
FIG. 3 is a perspective of another embodiment of the invention which includes segmented feed rolls.

The circuit connections of FIG. 3 are identical to those of FIG. 2 with the exception of the absence from FIG. 3 of the first reed switch RS2, its signal lead S2, the first magnetic brake MB1, driver amplifier DA1 its input lead IA1 and its output CS1. Also, the terminal pin pair #2, #4 are merely interconnected.

The control logic module CE, the photodetector head PDH, photodetector amplifier PDA, driver amplifier DA2, the reed switch RS1, and the 12 volt and 90 volt power supplies are all interconnected identically to the circuit of FIG. 2.

The photodetector head PDH and the fiber-optic bundle FOB are mounted on the web guide 20 intermediate the work station WS and the segmented feed rolls FR1 and FR2 to detect the passage of the registration marks RM on the web W.

OPERATION OF THE INVENTION

In the embodiment of FIGS. 1, 2 and 5, the second reed switch RS2 and its associated permanent magnet PM2 senses the maximum extent of the forward (right hand) stroke of the carriage 18 and the travelling magnetic brake MB1; and the first reed switch RS1 and its associated permanent magnet PM1 senses the end of the back (left hand) stroke of the carriage and magnetic brake MB1.

Generically, then, in both embodiments of the invention, the second reed switch RS1 senses the beginning of an incremental feed stroke imparted to the web W, whether by moving magnetic brake MB1 or the segmented feed rolls FR1, FR2 at the point at which the nip commences between the feed surface segments FR1A, FR2A.

In both embodiments, the web advance is set such that the absence of the registration marks RM and photodetector head PDH would result in an incremental advance greater than the actual incremental length desired as will become more fully apparent hereinafter.

Additionally, in both embodiments, the fixed magnetic brake MB2 is the one controlled by the photodetector head PDH, the photodetector amplifier PDA and the control module CE to engage the web W and preclude its advance beyond the desired incremental length.

With the foregoing operating parameters now established the operation of the preferred embodiments of the present invention will now be described.

A. Operation: Embodiment of FIGS. 1 and 2

Referring to FIGS. 1, 2 and 5, the drive shaft 26 is assumed to be rotating, thereby causing the crank arm 24, drive roller 22 and bearing plate 18C to reciprocate the carriage 18 and the first magnetic brake MB1 on the guide rails 16.

The first magnetic brake MB1 and the carriage 18 are shown at the end of the retraction or back stroke thereof, at which point, the permanent magnet PM1 passes by the first reed switch RS1 and completes the circuit from the #1 terminal pin of the control module CE, through the signal lead S1, switch RS1 and ground lead G1 to ground.

This causes the state of the terminal pin pair #2, #4 to switch such that the driver amplifier DA1 is energized via the input IA1 to complete the power circuit CS1, P1 through the core C1 and cause the armature A1 to clamp the web W between its lower surface 48 and the upper surface 46 of the coil C1, thereby gripping the web W and causing it to advance to the right with the advance stroke of the carriage 18.

Simultaneously, the terminal pin pair #3, #5 also changes state to de-energize the coil C2 of the second magnetic brake MB2 via the circuit IA2, DA2, CS2 and P2 to permit the web W to travel freely between the armature A2 and coil C2.

Now, before the completion of the slightly oversized advance stroke of the carriage 18, the next available registration mark RM will pass beneath the photodetector head PDH, causing energization of the photodetector amplifier PDA via the fiber-optic bundle FOB, thereby applying a control signal through the output lead SDA into the #6 terminal pin of the control module CE.

This reverses the state of the terminal pin pairs #2, #4 and #3, #5 such that the driver amplifiers DA1, DA2 de-energize and energize, respectively, the magnetic brakes MB1, MB2, thereby stopping the web W by the clamping action of the magnetic brake MB2 with a predetermined increment of the latter having been advanced to the work station (WS of FIG. 3) or the like.

In the event that no registration marks RM are used, i.e. plain web material is being incremented, the function of the second reed switch supplants that of the photodetector PDH by applying a signal the #6 terminal pin of the control module CE at the completion of the advance stroke of the carriage 18.

The resulting state change at the terminal pin pairs #2, #4 and #3, #5 release the moving magnetic brake MB1 and engage the fixed magnetic brake MB2 to effect the incremental advance of the web W as a function of the adjusted stroke length of the carriage 18.

Also, in the event that the photodetector malfunctions, the web W will be incremented to approximately the desired length in the operating mode in which registration marks RM are utilized.

B. Operation: The Embodiment of FIGS. 3 and 4

Referring now to FIGS. 3 and 4, and assuming that the position of the permanent magnet PM1 immediately adjacent the reed switch RS1 coincides with the initial nip of the feed rolls FR1, FR2 on the web W, the reed switch RS1 causes a signal to be applied to the #1 terminal pin of the control module CE via the signal lead S1 changing the state of the terminal pin pair #3, #5, thereby causing the driver amplifier DA2 to be de-energized through the lead IA2 and hence, the coil C2 of the magnetic brake MB2 to be de-energized through the control lead CS2. This commences an incremental feed cycle of the web W by the segmented feed rolls FR1, FR2.

As the web W is advanced, the next successive registration mark RM thereon passes beneath the photodetector head PDH, causing the fiber-optic bundle FOB to drive the photodetector amplifier PDA and impart a signal through the output lead SDA to the #6 terminal pin of the control module CE.

This results in a change of state at the terminal pin pair #3, #5 thereby energizing the driver amplifier DA2 via the lead IA2 and the coil C2 of the magnetic brake via the lead CS2 and power lead P2 to cause the armature A2 to clamp the web tightly against the coil and core C2. In this event, even if the nip of the surface segments FR1A, FR2A still exists, the feed rolls FR1, FR2 are caused to slip on the web W and the incremental advance is complete.

The foregoing advance cycle begins to repeat when the permanent magnet PM1 actuates the reed switch RS1.

One advantage of the deliberately excessive advance designed into the feed rolls FR1, FR2 and the lag time between nips made by the feed segments (corresponding to the retraction stroke of the carriage 18 in the embodiment of FIGS. 1 and 2) is that the resulting time interval between advances of the web W permits the work station WS to sever or otherwise operate on the advanced increment of the web W in full synchronism with the advance cycles.

Therefore, high speed synchronous operation combined with highly accurate incrementation of the web W is achieved.

Referring now to the dual magnetic clamp or brake assemblies of FIG. 6, the dual brake MBD comprises a lowermost first core and coil assembly CID mounted on a base 18DB and having a flat top surface 46D which cooperates with the lower surface 48D of an uppermost second core and coil assembly CIDA to clamp the web W therebetween when the core and coil assemblies CID and CIDA are energized by suitable electric currents establishing, respectively, substantially simultaneous reverse polarities therein.

The uppermost second coil and core assembly CIDA is mounted beneath a mounting plate MP which is, in turn, mounted on an upstanding spindle 42D, the latter being reciprocable to a limited extent in a vertical guide sleeve 44D fixed to an upper mounting bracket 18DA.

A common source of direct current power (+90VDC) is connected to both coil assemblies CIDA and CID and cooperates with respective driven amplifiers DAA and DAB to substantially simultaneously energize the said coil assemblies with reverse polarities under the control of the logic circuitry in the manner previously generally described herein.

The dual magnetic brake (clamp) assembly of FIG. 6 is intended for use in all embodiments of the present invention such as those illustrated in FIGS. 1, 2 and 3 hereof.

It is to be understood that the apparatus of the present invention may be modified as would occur to one of ordinary skill in the art without departing from the perspective and scope of the present invention.

It is claimed:

1. Web feeding means for advancing a web of material in successive predetermined increments from a supply of said web material comprising:

guide means receiving said web material from a supply thereof and supporting same over a predetermined length thereof;

intermittent drive means mounted adjacent said guide means and intermittently engaging said web means to advance same relative to said guide means at predetermined regular intervals;

control means responsive to a predetermined incremental advance of said web for generating a control signal; and magnetic brake means adjacent said web, upstream from said intermittent drive means, responsive to said control signal for engaging said web to preclude further advance thereof;

said intermittent drive means comprising:

a reciprocating carriage having advanced and retracted positions along said guide means; and second magnetic brake means mounted on said carriage for reciprocation therewith along said guide means in close proximity with said web; and wherein said control means includes:

first detector means sensing said retracted position of said carriage and generating a command signal in response thereto; and circuit means responsive to said command signal to actuate said second magnetic brake means and de-actuate said first magnetic brake means.

2. Web feeding means for advancing a web of material in successive predetermined increments from a supply of said web material comprising:

guide means receiving said web material from a supply thereof and supporting same over a predetermined length thereof;

intermittent drive means mounted adjacent said guide means and intermittently engaging said web means to advance same relative to said guide means at predetermined regular intervals;

control means responsive to a predetermined incremental advance of said web for generating a control signal; and magnetic brake means adjacent said web, upstream from said itermittent drive means, responsive to said control signal for engaging said web to preclude further advance thereof;

wherein said control means comprises:

first detector means responsive to the initiation of an advance cycle of said intermittent drive means for generating a command signal;

second detector means responsive to said predetermined incremental advance of said web means for generating said control signal;

logic means receiving said control and command signals and connected with said magnetic brake means for energizing and de-energizing said magnetic brake means in respective response to said control and command signals;

said intermittent drive means comprising segmented first and second feed rolls transversely disposed above and below said web for nipping said web between intermittently engaged coterminous circumferential segments having a peripheral dimension at least as large as said predetermined incremental advance of said web; and wherein actuation of said magnetic brake means precludes advance of said web by said feed rolls.

3. Web feeding means for advancing a web of material in successive predetermined increments from a supply of said web material comprising:

guide means receiving said web material from a supply thereof and supporting same over a predetermined length thereof;

intermittent drive means mounted adjacent said guide means and intermittently engaging said web means to advance same relative to said guide means at predetermined regular intervals;

control means responsive to a predetermined incremental advance of said web for generating a control signal; and magnetic brake means adjacent said web, upstream from said intermittent drive means, responsive to said control signal for engaging said web to preclude further advance thereof;

said control means comprising:

first detector means responsive the initiation of an advance cycle of said intermittnet drive means for generating a command signal;

second detector means responsive to said predetermined incremental advance of said web means for generating said control signal; and logic means receiving said control and command signals and connected with said magnetic brake means for energizing and de-energizing said magnetic brake means in respective response to said control and command signals;

said intermittent drive means comprising segmented first and second feed rolls transversely disposed above and below said web for nipping said web between intermittently engaged coterminous circumferential segments having a peripheral dimension at least as large as said predetermined incremental advance of said web;

wherein actuation of said magnetic brake means precludes advance of said web by said feed rolls;

wherein said web includes registration marks spaced thereon to define said successive predetermined incremental advances; and wherein said first detector means comprises photodetector means sensing the passage of each of said registration marks past a selected position on said guide means and generating said control signal in response thereto; and said second detector means is responsive to the initial engagement of said circumferential segments of said feed rolls for generating said command signal.

4. The invention defined in claim 1, wherein said control means further includes second detector means sensing the advanced position of said carriage and generating said control signal in response thereto; and wherein said circuit means is responsive to said control signal to de-actuate said second magnetic brake means and actuate said first magnetic brake means.

5. The invention defined in claim 1, wherein said web includes registration marks spaced thereon to define said successive predetermined incremental advances;

wherein said control means further includes photodetector means sensing the passage of each of said registration marks past a selected position on said guide means and generating said control signal in response thereto; and wherein said circuit means is responsive to said control signal to de-actuate said second magnetic brake means and actuate said first magnetic brake means.

6. The invention defined in claim 5, wherein said carriage and said second magnetic brake means advance said web in excess of said predetermined incremental advance in the absence of said control signal.

7. The invention defined in claim 5, wherein said control means further includes limit switch means sensing the advanced position of said carriage and responsive thereto to generate a second command signal; and wherein said circuit means is responsive to said second command signal in the absence of said control signal, to de-actuate said second magnetic brake means and actuate said first magnetic brake means.

8. Web feeding means for advancing successive predetermined increments of elongated web material from a supply thereof to a work station, comprising:

a machine base supporting said work station;

web guide means adjacent said work station and extending therefrom towards said web supply;

a machine frame supporting said web guide means and including drive support means;

intermittent drive means on said drive support means intermittently engaging said web and tending to advance said web in said guide means toward said work station in a succession of first increments of a length in excess of the ultimate desired length of said predetermined increments;

magnetic brake means mounted on said frame for selectively engaging said web in said guide means upstream of said itermittent guide means to preclude further advance of said web;

registration marks on said web spaced to define said ultimate desired predetermined incremental advances thereof; and control means responsive to said incremental advances of said web and the initiation of an advance thereof by said drive means generating control and command signals in respective response thereto;

said control means comprising:

photodetector means mounted adjacent said guide means and responsive to the passage of each of said registration marks for generating said control signal;

sensor means responsive to the initiation of the advance of said web by said drive means for generating said command signal; and logic circuit means connected between said photodetector and sensor means, receiving said control and command signals and actuating and de-actuating said magnetic brake means in respective response thereto;

said intermittent drive means comprising:

first and second segmented feed rolls positioned above and below said web means transversely of said guide means;

said feed rolls being commonly driven in timed relationship and having arcuate circumferential segments intermittently and coterminously engaging said web means to advance said web means a distance equal to the peripheral dimension of said segments; and wherein said sensor means is responsive to the initial mutual engagement of said segments with said web.

9. The invention defined in claim 8, wherein said web feeding means further includes drive means for rotating said feed rolls; and wherein said sensor means comprises:

permanent magnet means mounted on said drive means and being driven thereby past a sensing position corresponding to said initial mutual engagement of said segments with said web; and reed switch means mounted at said sensing position and actuated by the passage thereby of said permanent magnet means for generating said command signal.

10. Web feeding means for advancing successive predetermined increments of elongated web material from a supply thereof to a work station, comprising:

a machine base supporting said work station;

web guide means adjacent said work station and extending therefrom towards said web supply;

a machine frame supporting said web guide means and including drive support means;

intermittent drive means on said drive support means intermittently engaging said web and tending to advance said web in said guide means toward said work station in a succession of first increments of a length in excess of the ultimate desired length of said predetermined increments;

magnetic brake means mounted on said frame for selectively engaging said web in said guide means upstream of said intermittent guide means to preclude further advance of said web;

registration marks on said web spaced to define said ultimate desired predetermined incremental advances thereof; and control means responsive to said incremental advances of said web and the initiation of an advance thereof by said drive means generating control and command signals in respective response thereto;

said control means comprising:

photodetector means mounted adjacent said guide means and responsive to the passage of each of said registration marks for generating said control signal;

sensor means responsive to the initiation of the advance of said web by said drive means for generating said command signal; and logic circuit means connected between said photodetector and sensor means, receiving said control and command signals and actuating and de-actuating said magnetic brake means in respective response thereto;

said drive support means comprising:

carriage means reciprocating on said frame between advanced and retracted positions on said guide means;

said intermittent drive means comprising second magnetic brake means mounted on said carriage means in close proximity to said web;

wherein said sensor means is responsive to said retracted position of said carriage means; and wherein said logic circuit means is further responsive to said command and control signals for actuating and deactuating, respectively, said second magnetic brake means.

11. The invention defined in claim 10, wherein said web feeding means further includes drive means for reciprocating said carriage means; and wherein said sensor means comprises:

permanent magnet means mounted on said drive means and driven thereby past a sensing position corresponding to said retracted position of said carriage means; and reed switch means mounted at said sensing position and actuated by the passage thereby of said permanent magnet means for generating said command signal.

12. The invention defined in claim 11, wherein said web feed means further includes second senor means responsive to said advanced position of said carriage means generating a second command signal; and wherein said logic circuit means is responsive to said second command signal in the absence of said control signal for actuating the first said magnetic brake means and de-actuating said second magnetic brake means.

13. The invention defined in claim 12, wherein said second sensor means comprises:

second permanent magnet means mounted on said drive means and driven thereby past a second sensing position corresponding to said advanced position of said carriage means; and second reed switch means mounted at said second sensing position and actuated by the passage thereby of said second permanent magnet means for generating second command signal.

14. The invention defined in claim 1, wherein a said magnetic brake means comprises:

a first fixed magnetic coil and core assembly having a first clamping surface immediately adjacent one side of said web;

a second magnetic coil and core assembly freely mounted for movement toward and away from said first coil and core assembly and having a second clamping surface immediately adjacent to the opposite side of said web in opposition to said first clamping surface; and said control means further includes means for energizing said first and second coil and core assemblies at opposite magnetic polarities to engage said clamping surfaces with said web.

15. The invention defined in claim 2, wherein a said magnetic brake means comprises:

a first fixed magnetic coil and core assembly having a first clamping surface immediately adjacent one side of said web;

a second magnetic coil and core assembly freely mounted for movement toward and away from said first coil and core assembly and having a second clamping surface immediately adjacent to the opposite side of said web in opposition to said first clamping surface; and said control means further includes means for energizing said first and second coil and core assemblies at opposite magnetic polarities to engage said clamping surfaces with said web.

16. The invention defined in claim 3, wherein a said magnetic brake means comprises:

a first fixed magnetic coil and core assembly having a first clamping surface immediately adjacent one side of said web;

a second magnetic coil and core assembly freely mounted for movement toward and away from said first coil and core assembly and having a second clamping surface immediately adjacent to the opposite side of said web in opposition to said first clamping surface; and said control means further includes means for energizing said first and second coil and core assemblies at opposite magnetic polarities to engage said clamping surfaces with said web.

17. The invention defined in claim 4, wherein a said magnetic brake means comprises:

a first fixed magnetic coil and core assembly having a first clamping surface immediately adjacent one side of said web;

a second magnetic coil and core assembly freely mounted for movement toward and away from said first coil and core assembly and having a second clamping surface immediately adjacent to the opposite side of said web in opposition to said first clamping surface; and said control means further includes means for energizing said first and second coil and core assemblies at opposite magnetic polarities to engage said clamping surfaces with said web.

18. The invention defined in claim 5, wherein a said magnetic brake means comprises:

a first fixed magnetic coil and core assembly having a first clamping surface immediately adjacent one side of said web;

a second magnetic coil and core assembly freely mounted for movement toward and away from said first coil and core assembly and having a second clamping surface immediately adjacent to the opposite side of said web in opposition to said first clamping surface; and said control means further includes means for energizing said first and second coil and core assemblies at opposite magnetic polarities to engage said clamping surfaces with said web.

19. The invention defined in claim 6, wherein a said magnetic brake means comprises:

a first fixed magnetic coil and core assembly having a first clamping surface immediately adjacent one side of said web;

a second magnetic coil and core assembly freely mounted for movement toward and away from said first coil and core assembly and having a second clamping surface immediately adjacent to the opposite side of said web in opposition to said first clamping surface; and said control means further includes means for energizing said first and second coil and core assemblies at opposite magnetic polarities to engage said clamping surfaces with said web.

20. The invention defined in claim 7, wherein a said magnetic brake means comprises:

a first fixed magnetic coil and core assembly having a first clamping surface immediately adjacent one side of said web;

a second magnetic coil and core assembly freely mounted for movement toward and away from said first coil and core assembly and having a second clamping surface immediately adjacent to the opposite side of said web in opposition to said first clamping surface; and said control means further includes means for energizing said first and second coil and core assemblies at opposite magnetic polarities to engage said clamping surfaces with said web.

21. The invention defined in claim 8, wherein a said magnetic brake means comprises:

a first fixed magnetic coil and core assembly having a first clamping surface immediately adjacent one side of said web;

a second magnetic coil and core assembly freely mounted for movement toward and away from said first coil and core assembly and having a second clamping surface immediately adjacent to the opposite side of said web in opposition to said first clamping surface; and said control means further includes means for energizing said first and second coil and core assemblies at opposite magnetic polarities to engage said clamping surfaces with said web.

22. The invention defined in claim 9, wherein a said magnetic brake means comprises:

a first fixed magnetic coil and core assembly having a first clamping surface immediately adjacent one side of said web;

a second magnetic coil and core assembly freely mounted for movement toward and away from said first coil and core assembly and having a second clamping surface immediately adjacent to the opposite side of said web in opposition to said first clamping surface; and said control means further includes means for energizing said first and second coil and core assemblies at opposite magnetic polarities to engage said clamping surfaces with said web.

23. The invention defined in claim 10, wherein a said magnetic brake means comprises:

a first fixed magnetic coil and core assembly having a first clamping surface immediately adjacent one side of said web;

a second magnetic coil and core assembly freely mounted for movement toward and away from said first coil and core assembly and having a second clamping surface immediately adjacent to the opposite side of said web in opposition to said first clamping surface; and said control means further includes means for energizing said first and second coil and core assemblies at opposite magnetic polarities to engage said clamping surfaces with said web.

24. The invention defined in claim 11, wherein a said magnetic brake means comprises:

a first fixed magnetic coil and core assembly having a first clamping surface immediately adjacent one side of said web;

a second magnetic coil and core assembly freely mounted for movement toward and away from said first coil and core assembly and having a second clamping surface immediately adjacent to the opposite side of said web in opposition to said first clamping surface; and said control means further includes means for energizing said first and second coil and core assemblies at opposite magnetic polarities to engage said clamping surfaces with said web.

25. The invention defined in claim 12, wherein a said magnetic brake means comprises:

a first fixed magnetic coil and core assembly having a first clamping surface immediately adjacent one side of said web;

a second magnetic coil and core assembly freely mounted for movement toward and away from said first coil and core assembly and having a second clamping surface immediately adjacent to the opposite side of said web in opposition to said first clamping surface; and said control means further includes means for energizing said first and second coil and core assemblies at opposite magnetic polarities to engage said clamping surfaces with said web.

26. The invention defined in claim 13, wherein a said magnetic brake means comprises:

a first fixed magnetic coil and core assembly having a first clamping surface immediately adjacent one side of said web;

a second magnetic coil and core assembly freely mounted for movement toward and away from said first coil and core assembly and having a second clamping surface immediately adjacent to the opposite side of said web in opposition to said first clamping surface; and said control means further includes means for energizing said first and second coil and core assemblies at opposite magnetic polarities to engage said clamping surfaces with said web.

* * * * *